US012286205B1

(12) United States Patent
Wang et al.

(10) Patent No.: US 12,286,205 B1
(45) Date of Patent: Apr. 29, 2025

(54) MARINE FUEL CELL-BASED INTEGRATED HEAT, ELECTRICITY, AND COOLING SUPPLY SYSTEM

(71) Applicant: Wuhan Hydrogen Energy and Fuel Cell Industry Technology Research Institute Co., Ltd., Wuhan (CN)

(72) Inventors: Zhen Wang, Wuhan (CN); Tengfei Zhao, Wuhan (CN); Lingyi Xu, Wuhan (CN); Di Wang, Wuhan (CN); Bingrong Peng, Wuhan (CN)

(73) Assignee: Wuhan Hydrogen Energy and Fuel Cell Industry Technology Research Institute Co., Ltd., Wuhan (CN)

( * ) Notice: Subject to any disclaimer, the term of this patent is extended or adjusted under 35 U.S.C. 154(b) by 0 days.

(21) Appl. No.: 18/986,872

(22) Filed: Dec. 19, 2024

Related U.S. Application Data

(63) Continuation of application No. PCT/CN2024/136484, filed on Dec. 3, 2024.

(30) Foreign Application Priority Data

May 10, 2024 (CN) ..... 202410575078.X

(51) Int. Cl.
*B63H 21/20* (2006.01)
*B63H 21/00* (2006.01)
(Continued)

(52) U.S. Cl.
CPC ..... *B63H 21/20* (2013.01); *B63J 2/12* (2013.01); *B63J 3/04* (2013.01);
(Continued)

(58) Field of Classification Search
CPC ..... B63H 21/20; B63H 2021/003; B63H 2021/202; B63J 2/12; B63J 3/04; B63J 2002/125; B63J 2003/003; B63J 2003/046
See application file for complete search history.

(56) References Cited

U.S. PATENT DOCUMENTS 6,802,875 B1 * 10/2004 Kimbara ..... C01B 3/26 48/85.1
2022/0388618 A1 * 12/2022 Maruyama ..... H01M 8/2475
(Continued)

FOREIGN PATENT DOCUMENTS

CN 216429772 U 5/2022
CN 115614121 A 1/2023
CN 117039042 A 11/2023

OTHER PUBLICATIONS

CNIPA, Notification of a First Office Action for CN202410575078.X, Jun. 14, 2024.
(Continued)

*Primary Examiner* — Stephen P Avila
(74) *Attorney, Agent, or Firm* — Hemisphere Law, PLLC; Zhigang Ma

(57) ABSTRACT

Disclosed is a marine fuel cell-based integrated heat, electricity, and cooling supply system comprising a power supply system and a waste heat recovery system; the power supply system comprises wind turbine generator sets, solar generator sets, and a fuel cell power module; the waste heat recovery system encompasses a turbine power generation module and a lithium bromide refrigeration module; the fuel cell power module is connected to both the turbine power generation module and the lithium bromide refrigeration module; the turbine power generation module is used to generate electricity using waste heat. This approach fully exploits the waste heat from the exhaust gas generated by the fuel cell power module, resulting in a high overall energy utilization rate. The self-consumption electricity and pure hydrogen fuel for the integrated energy supply system can be obtained from solar and wind energy, ensuring low carbon emissions for the entire system.

8 Claims, 1 Drawing Sheet

(51) Int. Cl.

| | |
|---|---|
| ***B63J 2/12*** | (2006.01) |
| ***B63J 3/00*** | (2006.01) |
| ***B63J 3/04*** | (2006.01) |

(52) U.S. Cl.
CPC .. *B63H 2021/003* (2013.01); *B63H 2021/202* (2013.01); *B63J 2002/125* (2013.01); *B63J 2003/003* (2013.01); *B63J 2003/046* (2013.01)

(56) References Cited

U.S. PATENT DOCUMENTS

2022/0393202 A1* 12/2022 Hiraiwa ..... H01M 8/04455
2022/0393208 A1* 12/2022 Yamaguchi ..... H01M 8/249

OTHER PUBLICATIONS

Wuhan Hydrogen and Fuel Cell Industry Technology Research Institute Co., Ltd (Applicant), Replacement claims (allowed) of CN202410575078.X, Jun. 26, 2024.
CNIPA, Notification to grant patent right for invention in CN202410575078.X, Jul. 4, 2024.

* cited by examiner

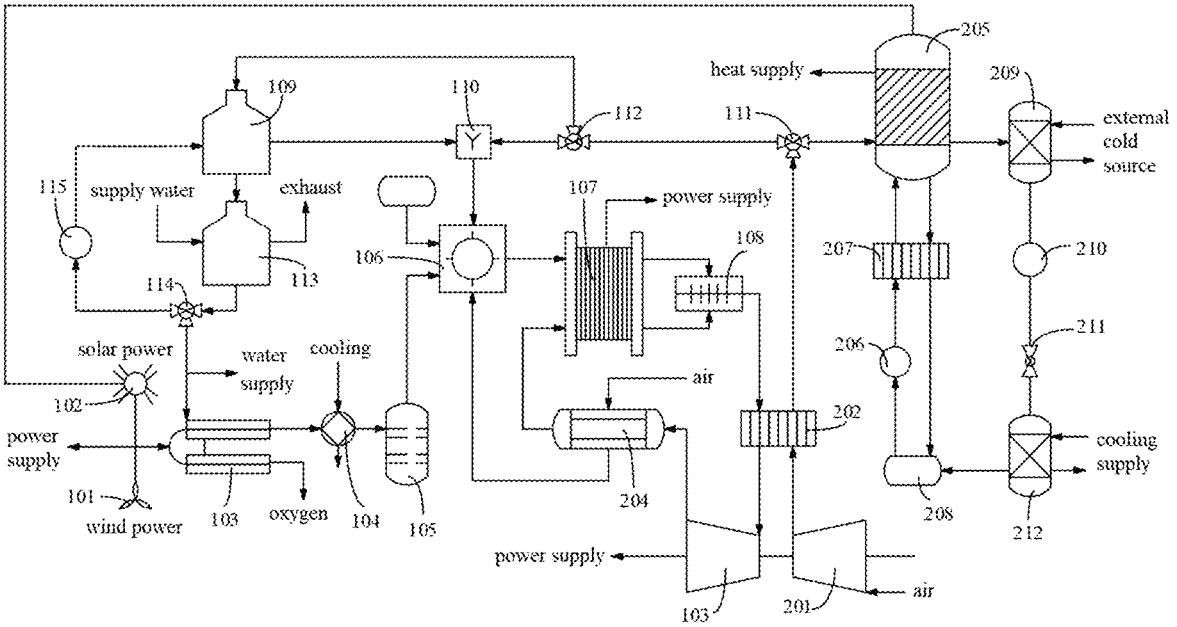
205
heat supply
209
external
cold
source
109
110
112
111
115
supply water
exhaust
107
power supply
108
106
207
210
113
114
211
solar power
water
supply
cooling
206
air
102
202
power
supply
cooling
supply
101
wind power
103
oxygen
104
105
204
208
212
power supply
103
201
air

MARINE FUEL CELL-BASED INTEGRATED HEAT, ELECTRICITY, AND COOLING SUPPLY SYSTEM

FIELD OF THE DISCLOSURE

The disclosure relates to the technical field of fuel cell, in particular to a marine fuel cell-based integrated heat, electricity, and cooling supply system.

BACKGROUND

Low-carbon and zero-carbon propulsion represents the most effective means for ships to reduce carbon emissions. The national dual-carbon (carbon peaking and carbon neutrality) and self-reliance strategies present market and policy opportunities for the development of ship propulsion systems in China. There are various pathways for ships to achieve carbon reduction, including hull form optimization, auxiliary energy-saving devices, low-carbon and zero-carbon fuels, efficient propulsion systems, new power systems, operational management, etc. Among them, low-carbon and zero-carbon fuels are the most direct and effective methods for reducing carbon emissions. These fuels offer carbon reduction rates ranging from 11% to 100%. By switching to low-carbon or zero-carbon fuels, carbon reductions and even carbon neutrality can be swiftly achieved.

Hydrogen and its derivatives, such as ammonia and methanol, stand out as the most promising zero-carbon alternative fuels for ships in the future, effectively addressing the urgent need for carbon reduction in the shipping industry. The development of hydrogen energy will also be a crucial measure for China to address the deep decarbonization requirements of the shipping industry in the long run. In the future, fuels used in fuel cells and internal combustion engines will gradually converge to low-carbon and zero-carbon fuels such as LNG, methanol, ammonia, and hydrogen. Fuel cells boast higher efficiency, greater power density, and lower vibration and noise compared to internal combustion engines. With further advancements in fuel cell technology and cost reductions, they will not only be applicable to inland and offshore ships but also have the potential for use in ocean-going vessels.

A Chinese patent CN117039042A discloses a combined cooling, heating, and power (CCHP) system using solid oxide cells and a method for the same. The system employs a solid oxide cell power generation module to generate electricity for the system and utilizes a lithium bromide absorption refrigeration module to harness the waste heat from the solid oxide cell power generation module. The solid oxide cell power generation module comprises solid oxide fuel cell units and solid oxide electrolysis cell units, where the solid oxide electrolysis cell units are used to process the anode exhaust gas from the solid oxide fuel cells within the solid oxide fuel cell units.

However, the aforementioned prior art fails to fully utilize the waste heat generated by the solid oxide cell power generation module, resulting in relatively low overall energy utilization efficiency.

SUMMARY

In view of this, it is necessary to provide a marine fuel cell-based integrated heat, electricity, and cooling supply system to address the technical problem in the existing technology, which is the inability to fully utilize the waste heat generated by the solid oxide cell power generation module, resulting in relatively low overall energy utilization efficiency.

This disclosure provides a marine fuel cell-based integrated heat, electricity, and cooling supply system, comprising a power supply system and a waste heat recovery system, wherein:

the power supply system comprises a wind turbine generator set, a solar generator set, and a fuel cell power module; the wind turbine generator set and the solar generator set generate electricity using wind energy and solar energy respectively, while the fuel cell power module generates electricity using hydrogen-based fuel;

the waste heat recovery system comprises a turbine power generation module and a lithium bromide refrigeration module; the fuel cell power module is connected to both the turbine power generation module and the lithium bromide refrigeration module; the turbine power generation module is used to generate electricity by utilizing waste heat produced by the fuel cell power module, while the lithium bromide refrigeration module is used to provide cooling and heating by utilizing waste heat produced by the fuel cell power module; wherein:

the fuel cell power module comprises a water electrolysis unit, a hydrogen compressor, a hydrogen storage unit, a fuel reforming facility, a solid oxide fuel cell power generation module, and a burner, which are connected in sequence; the water electrolysis unit is used for electrolyzing water to produce hydrogen; The hydrogen compressor is used for compressing the hydrogen and delivering it to the hydrogen storage unit; the fuel reforming facility is used for mixing and reforming hydrogen, high-temperature air, SOFC exhaust gas, and hydrogen-based fuel to obtain a mixture, and delivering the mixture to the solid oxide fuel cell power generation module for electricity generation; the burner is connected to the turbine power generation module and the lithium bromide refrigeration module; the burner is used for burning the exhaust gas produced by the solid oxide fuel cell power generation module and delivering the generated high-temperature exhaust gas to the turbine power generation module and the lithium bromide refrigeration module;

the turbine power generation module comprises a compressor, a gas heat exchanger, a turbine generator, and an air preheater; the compressor is connected to the cold side of the gas heat exchanger, the cold side of the gas heat exchanger is connected to the turbine generator; the hot side of the gas heat exchanger is connected to the burner; the gas heat exchanger serves to heat the air entering the turbine generator using the high-temperature exhaust gas generated by the burner; the hot side of the air preheater is connected to the turbine generator, while its cold side is connected to the solid oxide fuel cell power generation module; the air preheater is used to heat the air entering the solid oxide fuel cell power generation module using the exhaust gas produced by the turbine generator;

the air preheater is also connected to a pipe that supplies air to the fuel reforming facility, to preheat the air entering the fuel reforming facility using the high-temperature gas produced by the turbine generator; the high-temperature gas from the turbine generator undergoes heat exchange within the air preheater and ultimately enters the solid oxide fuel cell power generation module.

In some embodiments, the lithium bromide refrigeration module comprises a generator, an absorber, a condenser, and an evaporator; the generator is connected to the hot side of the gas heat exchanger; the generator contains an aqueous lithium bromide solution and is used to heat this solution with the high-temperature exhaust gas produced by the burner; the generator is cyclically connected to the absorber for the circulation of the aqueous lithium bromide solution; the generator is sequentially connected to the condenser, the evaporator, and the absorber; the generator is responsible for delivering water vapor to the condenser; the condenser is used to condense the water vapor into condensed water; the evaporator is used to convert the condensed water back into water vapor and provides cooling to external devices; the absorber is used to mix and dilute the water vapor with the aqueous lithium bromide solution.

In some embodiments, a first water pump and an expansion valve are connected sequentially between the condenser and the evaporator; the absorber delivers an aqueous lithium bromide solution to the generator via a lithium bromide solution pump.

In some embodiments, the generator delivers a concentrated aqueous lithium bromide solution to the absorber through a first pipe, and the absorber delivers a diluted aqueous lithium bromide solution to the generator through a second pipe; the lithium bromide refrigeration module also comprises a heat exchanger, where the first pipe is connected to the hot side of the heat exchanger, and the second pipe is connected to the cold side of the heat exchanger.

In some embodiments, the evaporator is connected to the hydrogen compressor through a cooling supply pipe, and the evaporator is used to provide cooling to the hydrogen compressor.

In some embodiments, the power supply system also comprises a boiler and a steam superheater; the steam outlet of the boiler is connected to the steam superheater, and the outlet of the steam superheater is connected to the fuel reforming facility; the steam superheater is used to heat the steam generated by the boiler and deliver it to the fuel reforming facility.

In some embodiments, the power supply system also comprises a first three-way valve and a second three-way valve; the hot side of the gas heat exchanger is connected to both the second three-way valve and the generator of the lithium bromide refrigeration module through the first three-way valve; the second three-way valve is connected to both the steam superheater and the boiler.

In some embodiments, the power supply system also comprises a condensate tank, a third three-way valve, and a second water pump; the inlet of the condensate tank is connected to the outlet of the boiler, and the outlet of the condensate tank is connected to both the second water pump and the water electrolysis unit through the third three-way valve; the second water pump is connected to the boiler; the condensate tank is used to condense the water vapor generated by the boiler and deliver the water to both the boiler and the water electrolysis unit.

Compared with the existing technology, the marine fuel cell-based integrated heat, electricity, and cooling supply system provided in this disclosure features a wind turbine generator set and a solar generator set that generate electricity using wind energy and solar energy, respectively, while the fuel cell power module generates electricity using hydrogen-based fuel. The fuel cell power module is connected to the turbine power generation module and the lithium bromide refrigeration module. The turbine power generation module utilizes the waste heat generated by the fuel cell power module to produce additional electricity, and the lithium bromide refrigeration module uses this waste heat for both cooling and heating purposes. In this disclosure, electrical energy is sourced from the wind turbine generator set, the solar generator set, the fuel cell power module, and the turbine power generation module. Thermal energy is derived from the high-temperature exhaust gas produced by the fuel cell power module, while cold energy is supplied by the lithium bromide refrigeration module. This system is capable of providing electrical energy, thermal energy, and cold energy for large ocean-going vessels; using the fuel cell power module as the main power source for the ship, a portion of the waste heat from the exhaust gas generated by the fuel cell power module is utilized by the turbine power generation module to supply electricity to the ship, while another portion is used by the lithium bromide refrigeration module to provide cooling energy. The excess waste heat from the exhaust gas is harnessed to provide thermal energy for the ship. This approach fully exploits the waste heat from the exhaust gas of the fuel cell power module, resulting in high overall energy utilization efficiency. Moreover, the self-consumption electricity and pure hydrogen fuel for the integrated energy supply system can be obtained from solar and wind energy, ensuring low carbon emissions for the entire integrated energy supply system.

BRIEF DESCRIPTION OF THE DRAWINGS

The accompanying FIGURES described herein are provided to offer a further understanding of this disclosure and constitute a part of this disclosure. The illustrative embodiments of this disclosure and their descriptions are used to explain this disclosure and do not constitute an improper limitation of this disclosure. In the accompanying FIGURES:

FIG. 1 is a schematic diagram illustrating the structure of an embodiment of the marine fuel cell-based integrated heat, electricity, and cooling supply system provided by this disclosure.

DETAILED DESCRIPTION OF PREFERRED EMBODIMENTS

Below, preferred embodiments of this disclosure will be described in detail with reference to the accompanying drawings, which form a part of this disclosure and are used together with the embodiments of this disclosure to illustrate the principles of this disclosure, rather than to limit the scope of this disclosure.

Please refer to FIG. 1, this disclosure provides a marine fuel cell-based integrated heat, electricity, and cooling supply system, comprising a power supply system and a waste heat recovery system. The power supply system comprises a wind turbine generator set 101, a solar generator set 102, and a fuel cell power module. The wind turbine generator set 101 and the solar generator set 102 generate electricity using wind energy and solar energy, respectively, while the fuel cell power module generates electricity using hydrogen-based fuel. The waste heat recovery system comprises a turbine power generation module and a lithium bromide refrigeration module. The fuel cell power module is connected to both the turbine power generation module and the lithium bromide refrigeration module. The turbine power generation module is used to generate electricity using waste heat produced by the fuel cell power module, while the lithium bromide refrigeration module is used to provide cooling and heating utilizing the waste heat produced by the fuel cell power module.

The marine fuel cell-based integrated heat, electricity, and cooling supply system disclosed in this disclosure features a wind turbine generator set 101 and a solar generator set 102 to generate electricity from wind and solar energy, respectively, while a fuel cell power module generates electricity using hydrogen-based fuel. The fuel cell power module is connected to a turbine power generation module and a lithium bromide refrigeration module. The turbine power generation module is used to generate electricity from the waste heat produced by the fuel cell power module, and the lithium bromide refrigeration module is used to provide cooling and heating using the waste heat from the fuel cell power module. In this application, electrical energy is sourced from the wind turbine generator set 101, the solar generator set 102, the fuel cell power module, and the turbine power generation module. Thermal energy is derived from the high-temperature exhaust gas produced by the fuel cell power module, while cold energy is sourced from the lithium bromide refrigeration module. This system is capable of providing electrical, thermal, and cold energy for large ocean-going vessels. With the fuel cell power module serving as the primary power source for the vessel, a portion of the waste heat from the exhaust gas of the fuel cell power module is used to generate electricity through the turbine power generation module, another portion is used to provide cold energy through the lithium bromide refrigeration module, and the excess waste heat is utilized to provide thermal energy for the vessel. This approach fully utilizes the waste heat from the exhaust gas of the fuel cell power module, resulting in high overall energy utilization efficiency. Furthermore, the self-consumption electricity and pure hydrogen fuel of the aforementioned integrated energy supply system can be obtained from solar and wind energy, ensuring low carbon emissions for the entire integrated energy supply system.

Furthermore, in this embodiment, the fuel cell power module comprises a water electrolysis unit 103, a hydrogen compressor 104, a hydrogen storage unit 105, a fuel reforming facility 106, a solid oxide fuel cell power generation module 107, and a burner 108, which are connected in sequence. The water electrolysis unit 103 is used for producing hydrogen through water electrolysis. The hydrogen compressor 104 is used for compressing hydrogen and transporting it to the hydrogen storage unit 105. The fuel reforming facility 106 is used for mixing and reforming hydrogen, high-temperature air, SOFC exhaust gas, and hydrogen-based fuel, and transporting the resultant mixture to the solid oxide fuel cell power generation module 107 for power generation. The burner 108 is connected to the turbine power generation module and the lithium bromide refrigeration module. The burner 108 is used for burning the exhaust gas produced by the solid oxide fuel cell power generation module 107 and transporting the generated high-temperature exhaust gas to the turbine power generation module and the lithium bromide refrigeration module Specifically, the water electrolysis unit 103 produces hydrogen and oxygen through water electrolysis. The oxygen can be directly discharged into the atmosphere, while the hydrogen is transported to the hydrogen compressor 104. Through compression by the hydrogen compressor 104, the hydrogen is brought to a high-temperature, high-pressure state and then transported to the hydrogen storage unit 105 for storage. When hydrogen is needed, it is supplied from the hydrogen storage unit 105 to the fuel reforming facility 106. At the same time, hydrogen-based fuels on the ship are also connected to and supplied into the fuel reforming facility 106. Additionally, high-temperature air, SOFC exhaust gas, and water vapor are introduced into the fuel reforming facility 106. Within the facility, the high-temperature air, SOFC exhaust gas, and mature marine low-carbon hydrogen-based fuels such as LNG or methanol undergo mixed reforming. The resultant mixture is then fed into the solid oxide fuel cell power generation module 107 to generate electricity. During electricity generation, the solid oxide fuel cell power generation module 107 also produces flammable high-temperature exhaust gas. To avoid environmental pollution and make full use of waste heat, the high-temperature exhaust gas is directed into the burner 108, where it mixes with air also introduced into the burner 108 and combusts, producing even higher-temperature exhaust gas. This high-temperature exhaust gas is then supplied to the turbine power generation module and the lithium bromide refrigeration module for waste heat utilization.

The electrical energy required by the water electrolysis unit 103 can be supplied by the wind turbine generator set 101 and the solar generator set 102.

Furthermore, in this embodiment, the turbine power generation module comprises a compressor 201, a gas heat exchanger 202, a turbine generator 203, and an air preheater 204. The compressor 201 is connected to the cold side of the gas heat exchanger 202. The cold side of the gas heat exchanger 202 is connected to the turbine generator 203. The hot side of the gas heat exchanger 202 is connected to the burner 108. The gas heat exchanger 202 is used to heat the air entering the turbine generator 203 using the high-temperature exhaust gas produced by the burner 108. The hot side of the air preheater 204 is connected to the turbine generator 203. The cold side of the air preheater 204 is connected to the solid oxide fuel cell power generation module 107. The air preheater 204 is used to heat the air entering the solid oxide fuel cell power generation module 107 using the exhaust gas produced by the turbine generator 203.

Specifically, the high-temperature exhaust gas discharged from the burner 108 first passes through the hot side of the gas heat exchanger 202 and enters the generator 205. The compressor 201 is capable of compressing air to bring it to a high-pressure state, and then transports the high-pressure air to the cold side of the gas heat exchanger 202, allowing the high-pressure air to exchange heat with the high-temperature exhaust gas. This utilizes the temperature of the high-temperature exhaust gas to heat the high-pressure air, converting it into the high-temperature, high-pressure air required by the turbine generator 203. Finally, the high-temperature, high-pressure air enters the turbine generator 203 to generate electricity, providing electrical power to the ship. The air after doing work is then directed into the air preheater 204, which is also connected to the pipe that supplies air to the fuel reforming facility 106. This allows the high-temperature gas produced by the turbine generator 203 to preheat the air entering the fuel reforming facility 106. The high-temperature gas produced by the turbine generator 203, after exchanging heat in the air preheater 204, ultimately enters the solid oxide fuel cell power generation module 107.

Furthermore, in this embodiment, the lithium bromide refrigeration module comprises a generator 205, an absorber 208, a condenser 209, and an evaporator 212. The generator 205 is connected to the hot side of the gas heat exchanger 202. The generator 205 contains an aqueous lithium bromide solution and is used to heat this solution with the high-temperature exhaust gas produced by the burner 108. The generator 205 is cyclically connected to the absorber 208 for the circulation of the aqueous lithium bromide solution. The generator 205 is sequentially connected to the condenser 209, the evaporator 212, and the absorber 208. The generator 205 is responsible for delivering water vapor to the condenser 209. The condenser 209 is used to condense the water vapor into condensed water. The evaporator 212 is used to convert the condensed water back into water vapor and provides cooling to external devices. The absorber 208 is used to mix and dilute the water vapor with the aqueous lithium bromide solution.

In specific applications, the high-temperature exhaust gas generated by the burner 108 heats the aqueous lithium bromide solution within the generator 205, causing it to produce water vapor. Simultaneously, the concentration of the aqueous lithium bromide solution gradually increases. At this point, the high-concentration aqueous lithium bromide solution is transported to the absorber 208, while the generated water vapor is sent to the condenser 209. Through heat exchange with an external cold source within the condenser 209, the water vapor condenses into high-pressure, low-temperature liquid water. This liquid water is then transported to the evaporator 212, where it undergoes rapid expansion and vaporization. During this vaporization process, a significant amount of heat is absorbed from the refrigerant within the evaporator 212, achieving the purpose of cooling and refrigeration, enabling the evaporator 212 to provide cooling to external devices. The water vapor vaporized within the evaporator 212 is then transported to the absorber 208, diluting the concentration of the aqueous lithium bromide solution within the absorber 208. The diluted aqueous lithium bromide solution is then transported back to the generator 205, completing the refrigeration cycle. After heating the aqueous lithium bromide solution within the generator 205, the high-temperature exhaust gas produced by the burner 108 is discharged from the generator 205, enabling external heat supply. This configuration allows the lithium bromide refrigeration module to provide both external cooling and heating.

Furthermore, to achieve fluid transfer between various instruments in this embodiment, a first water pump 210 and an expansion valve 211 are connected sequentially between the condenser 209 and the evaporator 212. The absorber 208 delivers an aqueous lithium bromide solution to the generator 205 via a lithium bromide solution pump 206.

Furthermore, in this embodiment, the generator 205 delivers a concentrated aqueous lithium bromide solution to the absorber 208 through a first pipe, and the absorber 208 delivers a diluted aqueous lithium bromide solution to the generator 205 through a second pipe. The lithium bromide refrigeration module also comprises a heat exchanger 207, where the first pipe is connected to the hot side of the heat exchanger 207, and the second pipe is connected to the cold side of the heat exchanger 207.

Furthermore, during the operation of the hydrogen compressor 104, a significant amount of heat is generated, which can adversely affect its performance. Therefore, in this embodiment, the evaporator 212 is connected to the hydrogen compressor 104 through a cooling supply pipe, and the evaporator 212 is used to provide cooling to the hydrogen compressor 104. With this arrangement, cooling is supplied to the hydrogen compressor 104 to reduce its temperature.

Furthermore, within the fuel reforming facility 106, water vapor is required. In this embodiment, the power supply system also comprises a boiler 109 and a steam superheater 110. The steam outlet of the boiler 109 is connected to the steam superheater 110, and the outlet of the steam superheater 110 is connected to the fuel reforming facility 106. The steam superheater 110 is used to heat the steam generated by the boiler 109 and deliver it to the fuel reforming facility 106. By installing the boiler 109, water vapor can be supplied to the fuel reforming facility 106.

Furthermore, the power supply system also comprises a first three-way valve 111 and a second three-way valve 112. The hot side of the gas heat exchanger 202 is connected to both the second three-way valve 112 and the generator 205 of the lithium bromide refrigeration module through the first three-way valve 111. The second three-way valve 112 is connected to both the steam superheater 110 and the boiler 109. A portion of the high-temperature exhaust gas produced by the burner 108 is delivered to the generator 205, another portion is delivered to the steam superheater 110, and the remaining portion is delivered to the boiler 109. This configuration allows for the full utilization of the high-temperature exhaust gas generated by the burner 108.

Furthermore, the boiler 109 generates a large amount of water vapor. In this embodiment, the power supply system also comprises a condensate tank 113, a third three-way valve 114, and a second water pump 115. The inlet of the condensate tank 113 is connected to the outlet of the boiler 109, and the outlet of the condensate tank 113 is connected to both the second water pump 115 and the water electrolysis unit 103 through the third three-way valve 114. The second water pump 115 is connected to the boiler 109. The condensate tank 113 is used to condense the water vapor generated by the boiler 109 and deliver the water to both the boiler 109 and the water electrolysis unit 103.

The specific working principle of this disclosure is as follows:

In the power supply circuit, the wind turbine generator set 101 and the solar generator set 102 installed on the ship generate electricity to provide power for external devices. Additionally, through the water electrolysis unit 103, pure hydrogen and pure oxygen are produced, with the pure oxygen being directly discharged. The pure hydrogen, after being pressurized by the hydrogen compressor 104, becomes high-temperature, high-pressure hydrogen and is stored in the hydrogen storage unit 105. When in use, the hydrogen is transported to the fuel reforming facility 106, where it undergoes mixed reforming with high-temperature air, SOFC exhaust gas, and mature marine low-carbon hydrogen-based fuels such as LNG or methanol. The reformed hydrogen then enters the solid oxide fuel cell power generation module 107 to generate electricity. The exhaust gas produced by the solid oxide fuel cell power generation module 107 continues to burn in the burner 108, generating high-temperature exhaust gas. This high-temperature exhaust gas, through the gas heat exchanger 202, can heat the cold-end air of the turbine generator. It is then distributed to the refrigeration circuit and exhaust gas treatment circuit as needed through the first three-way valve 111 and the second three-way valve 112. In the exhaust gas treatment circuit, the high-temperature exhaust gas is transported to the steam superheater 110 and the fuel reforming facility 106 via the first and second three-way valves 111 and 112. The steam superheater 110 also receives high-temperature steam generated by the boiler 109. Alternatively, the high-temperature exhaust gas can bypass directly to the boiler 109 through the second three-way valve 112 to preheat the feedwater. The steam from the boiler 109, after condensation, is stored in the condensate tank 113, while other exhaust gases are discharged into the atmosphere. The condensed water can serve as an additional water source for the water electrolysis unit 103, or be provided externally, or supplied to the boiler 109. Furthermore, air is pressurized by the compressor 201 and then absorbs waste heat from the high-temperature exhaust gas produced by the burner 108 in the gas heat exchanger 202. The heated air then generates electricity in the turbine generator 203. Finally, the high-temperature air, after preheating ambient air in the air preheater 204, enters the solid oxide fuel cell power generation module 107.

In the heat supply circuit, high-temperature exhaust gas passes through the gas heat exchanger 202 to heat the compressed air from the outlet of the compressor 201. It is then distributed to the generator 205 as needed through the first three-way valve 111. After heating the lithium bromide aqueous solution inside the generator 205, it supplies heat to the outside.

In the cold supply circuit, the lithium bromide aqueous solution in the generator 205 absorbs the waste heat from high-temperature exhaust gas, causing the water within the solution to continuously vaporize. As a result, the concentration of the lithium bromide aqueous solution in the generator 205 increases and it flows into the absorber 208. Meanwhile, the water vapor enters the condenser 209, where it is cooled and condensed by external cooling water into high-pressure, low-temperature liquid water. When this water passes through the first water pump 210 and the expansion valve 211 into the evaporator 212, it rapidly expands and vaporizes, absorbing a significant amount of heat from the refrigerant in the evaporator 212 during the vaporization process, thereby achieving the purpose of cooling and refrigeration. During this process, the low-temperature water vapor enters the absorber 208 and is absorbed by the lithium bromide aqueous solution inside, gradually reducing the solution's concentration. The solution is then pumped back to the generator 205 by the lithium bromide solution pump 206. Additionally, the refrigerant in the evaporator 212 can also be used for cooling the hydrogen compressor 104.

This disclosure provides electrical, thermal, and cooling energy for ships through an integrated energy system combining wind, solar, and traditional shipboard hydrogen-based fuels. The electrical energy is sourced from the wind turbine generator set 101, solar generator set 102, solid oxide fuel cell power generation module 107, and turbine generator 203. The thermal energy is derived from the high-temperature exhaust gas from the burner 108 at the rear of the solid oxide fuel cell power generation module 107. The cooling energy is supplied by the lithium bromide refrigeration module. In this integrated energy supply system, the thermal energy is also utilized for heating the inlet air of the solid oxide fuel cell power generation module 107, the inlet air of the compressor 201, and the generator 205. The cooling energy is used for cooling the hydrogen compressor 104. This application boasts a high overall energy utilization rate and achieves significant emission reductions through the use of hydrogen-based fuels such as LNG, methanol, and ammonia, making it an ideal form of green ship propulsion.

In the description of this disclosure, it should be noted that when directional indications (such as up, down, left, right, front, rear, etc.) are involved, they are solely used to explain the relative positional relationships and movements between various components in a specific orientation (as shown in the accompanying drawings). If this specific orientation changes, the directional indications will change accordingly. Unless otherwise specified or limited, the terms "installed," "connected," and "linked" should be broadly interpreted. For example, they can refer to fixed connections, detachable connections, or integral connections; mechanical connections or electrical connections; direct connections or indirect connections through intermediary media; or internal communications between two elements. For those skilled in the art, the specific meanings of these terms in this disclosure can be understood based on the specific context.

It should be noted in this disclosure that relational terms such as "first" and "second" are used solely to distinguish one entity or operation from another, without necessarily requiring or implying any actual relationship or sequence between these entities or operations. Furthermore, the terms "comprise," "contain," or any other variations thereof are intended to cover non-exclusive inclusions, such that a process, method, article, or apparatus that includes a list of elements not only includes those elements but may also include other elements not explicitly listed or inherently included in such a process, method, article, or apparatus. In the absence of further limitations, elements defined by the statement "including one . . . " do not exclude the presence of additional identical elements in the process, method, article, or apparatus that includes the stated elements. Additionally, the term "and/or" throughout the text encompasses three concurrent scenarios. Taking "A and/or B" as an example, it includes scenarios where A is present, B is present, or both A and B are present simultaneously. Furthermore, the technical solutions among various embodiments may be combined with each other, but this must be based on the feasibility for ordinary skilled persons in the art. When the combination of technical solutions leads to contradictions or is unachievable, such a combination should be deemed as non-existent and not within the scope of protection claimed in this disclosure.

The above description merely presents preferred specific embodiments of this disclosure, but the scope of protection of this disclosure is not limited to them. Any variations or substitutions that can be easily conceived by those skilled in the art within the technical scope disclosed in this disclosure should be encompassed within the scope of protection of this disclosure.

What is claimed is:

1. A marine fuel cell-based integrated heat, electricity, and cooling supply system, comprising a power supply system and a waste heat recovery system, wherein:

the power supply system comprises a wind turbine generator set, a solar generator set, and a fuel cell power module; the wind turbine generator set and the solar generator set generate electricity using wind energy and solar energy respectively, while the fuel cell power module generates electricity using hydrogen-based fuel;

the waste heat recovery system comprises a turbine power generation module and a lithium bromide refrigeration module; the fuel cell power module is connected to both the turbine power generation module and the lithium bromide refrigeration module; the turbine power generation module is used to generate electricity by utilizing waste heat produced by the fuel cell power module, while the lithium bromide refrigeration module is used to provide cooling and heating by utilizing waste heat produced by the fuel cell power module; wherein:

the fuel cell power module comprises a water electrolysis unit, a hydrogen compressor, a hydrogen storage unit, a fuel reforming facility, a solid oxide fuel cell power generation module, and a burner, which are connected in sequence; the water electrolysis unit is used for electrolyzing water to produce hydrogen; The hydrogen compressor is used for compressing the hydrogen and delivering it to the hydrogen storage unit; the fuel reforming facility is used for mixing and reforming hydrogen, high-temperature air, SOFC exhaust gas, and hydrogen-based fuel to obtain a mixture, and delivering the mixture to the solid oxide fuel cell power generation module for electricity generation; the burner is connected to the turbine power generation module and the lithium bromide refrigeration module; the burner is used for burning the exhaust gas produced by the solid oxide fuel cell power generation module and delivering the generated high-temperature exhaust gas to the turbine power generation module and the lithium bromide refrigeration module;

the turbine power generation module comprises a compressor, a gas heat exchanger, a turbine generator, and an air preheater; the compressor is connected to the cold side of the gas heat exchanger, the cold side of the gas heat exchanger is connected to the turbine generator; the hot side of the gas heat exchanger is connected to the burner; the gas heat exchanger serves to heat the air entering the turbine generator using the high-temperature exhaust gas generated by the burner; the hot side of the air preheater is connected to the turbine generator, while its cold side is connected to the solid oxide fuel cell power generation module; the air preheater is used to heat the air entering the solid oxide fuel cell power generation module using the exhaust gas produced by the turbine generator;

the air preheater is also connected to a pipe that supplies air to the fuel reforming facility, to preheat the air entering the fuel reforming facility using the high-temperature gas produced by the turbine generator; the high-temperature gas from the turbine generator undergoes heat exchange within the air preheater and ultimately enters the solid oxide fuel cell power generation module.

2. The marine fuel cell-based integrated heat, electricity, and cooling supply system according to claim 1, wherein the lithium bromide refrigeration module comprises a generator, an absorber, a condenser, and an evaporator; the generator is connected to the hot side of the gas heat exchanger; the generator contains an aqueous lithium bromide solution and is used to heat this solution with the high-temperature exhaust gas produced by the burner; the generator is cyclically connected to the absorber for the circulation of the aqueous lithium bromide solution; the generator is sequentially connected to the condenser, the evaporator, and the absorber; the generator is responsible for delivering water vapor to the condenser; the condenser is used to condense the water vapor into condensed water; the evaporator is used to convert the condensed water back into water vapor and provides cooling to external devices; the absorber is used to mix and dilute the water vapor with the aqueous lithium bromide solution.

3. The marine fuel cell-based integrated heat, electricity, and cooling supply system according to claim 2, wherein a first water pump and an expansion valve are connected sequentially between the condenser and the evaporator; the absorber delivers an aqueous lithium bromide solution to the generator via a lithium bromide solution pump.

4. The marine fuel cell-based integrated heat, electricity, and cooling supply system according to claim 2, wherein the generator delivers a concentrated aqueous lithium bromide solution to the absorber through a first pipe, and the absorber delivers a diluted aqueous lithium bromide solution to the generator through a second pipe; the lithium bromide refrigeration module also comprises a heat exchanger, where the first pipe is connected to the hot side of the heat exchanger, and the second pipe is connected to the cold side of the heat exchanger.

5. The marine fuel cell-based integrated heat, electricity, and cooling supply system according to claim 2, wherein the evaporator is connected to the hydrogen compressor through a cooling supply pipe, and the evaporator is used to provide cooling to the hydrogen compressor.

6. The marine fuel cell-based integrated heat, electricity, and cooling supply system according to claim 1, wherein the power supply system also comprises a boiler and a steam superheater; the steam outlet of the boiler is connected to the steam superheater, and the outlet of the steam superheater is connected to the fuel reforming facility; the steam superheater is used to heat the steam generated by the boiler and deliver it to the fuel reforming facility.

7. The marine fuel cell-based integrated heat, electricity, and cooling supply system according to claim 6, wherein the power supply system also comprises a first three-way valve and a second three-way valve; the hot side of the gas heat exchanger is connected to both the second three-way valve and the generator of the lithium bromide refrigeration module through the first three-way valve; the second three-way valve is connected to both the steam superheater and the boiler.

8. The marine fuel cell-based integrated heat, electricity, and cooling supply system according to claim 6, wherein the power supply system also comprises a condensate tank, a third three-way valve, and a second water pump; the inlet of the condensate tank is connected to the outlet of the boiler, and the outlet of the condensate tank is connected to both the second water pump and the water electrolysis unit through the third three-way valve; the second water pump is connected to the boiler; the condensate tank is used to condense the water vapor generated by the boiler and deliver the water to both the boiler and the water electrolysis unit.

* * * * *